US006062766A

United States Patent [19]

Fleury et al.

[11] Patent Number: 6,062,766

[45] Date of Patent: May 16, 2000

[54] RAISED PAVEMENT MARKER

[75] Inventors: Michael T. Fleury, Racine, Wis.; Jeffery S. Held, Chicago, Ill.; Robert D. Giese, Kenosha, Wis.; Richard R. Figlewicz, Mt. Prospect, Ill.

[73] Assignee: Quixote Corporation, Chicago, Ill.

[21] Appl. No.: 08/905,468

[22] Filed: Aug. 4, 1997

[51] Int. Cl.[7] ..... E01F 9/00; E01F 9/06; E01F 9/08

[52] U.S. Cl. ..... 404/11; 404/10; 404/12; 404/13

[58] Field of Search ..... 404/11, 16, 12, 404/13, 10

[56] References Cited

U.S. PATENT DOCUMENTS

| | | | |
|---|---|---|---|
| D. 266,060 | 9/1982 | Beretta . | |
| D. 266,554 | 10/1982 | Beretta . | |
| D. 327,230 | 6/1992 | Hedgewick . | |
| D. 346,984 | 5/1994 | Hedgewick . | |
| D. 348,411 | 7/1994 | Hedgewick . | |
| 1,295,021 | 2/1919 | Friel . | |
| 3,292,506 | 12/1966 | Kone . | |
| 3,377,930 | 4/1968 | Kone . | |
| 3,499,371 | 3/1970 | Jonnes et al. . | |
| 3,703,855 | 11/1972 | Converso . | |
| 3,717,076 | 2/1973 | Shields et al. . | |
| 3,850,536 | 11/1974 | Kone . | |
| 3,879,148 | 4/1975 | Eigenmann . | |
| 3,901,614 | 8/1975 | Overacker . | |
| 4,049,358 | 9/1977 | King et al. | 404/11 |
| 4,147,447 | 4/1979 | Heenan et al. . | |
| 4,155,666 | 5/1979 | Flanagan . | |
| 4,174,184 | 11/1979 | Heenan . | |
| 4,186,968 | 2/1980 | Barton . | |
| 4,195,945 | 4/1980 | Heenan . | |
| 4,218,059 | 8/1980 | Eiden . | |
| 4,232,979 | 11/1980 | Johnson, Jr. et al. . | |
| 4,234,264 | 11/1980 | Baldi . | |
| 4,340,319 | 7/1982 | Johnson, Jr. et al. . | |
| 4,504,169 | 3/1985 | Jones . | |
| 4,507,254 | 3/1985 | Daniels et al. . | |
| 4,557,624 | 12/1985 | Walker . | |
| 4,595,312 | 6/1986 | Corless . | |
| 4,596,622 | 6/1986 | Heenan et al. . | |
| 4,597,691 | 7/1986 | Clarke . | |
| 4,618,281 | 10/1986 | Bjemian . | |
| 4,653,955 | 3/1987 | Racs . | |
| 4,753,548 | 6/1988 | Forrer . | |
| 4,797,024 | 1/1989 | Forrer . | |
| 4,848,958 | 7/1989 | Sheldon . | |
| 4,854,768 | 8/1989 | Flanagan et al. | 404/11 |
| 4,883,384 | 11/1989 | Hedgewick . | |
| 4,955,982 | 9/1990 | Paulos . | |
| 5,002,424 | 3/1991 | Hedgewick . | |
| 5,061,114 | 10/1991 | Hedgewick . | |
| 5,069,577 | 12/1991 | Murphy . | |
| 5,074,706 | 12/1991 | Paulos . | |

(List continued on next page.)

OTHER PUBLICATIONS

Brochure *The Best Show on the Road*, IronStar from HAllen Products, Copyright 1997 HAllen Products, Ltd.

Brochure *Stimsonite Recyclable, Snowplowable Reflective Pavement Markers*, 1994 Stimsonite Corporation.

U.S. Patent Application Serial No. 08/780,378, filed Jan. 8, 1997.

*Primary Examiner*—James A. Lisehora
*Assistant Examiner*—Gary S. Hartmann
*Attorney, Agent, or Firm*—Brinks Hofer Gilson & Lione

[57] ABSTRACT

A raised pavement marker includes a reflector assembly that is resiliently supported by a membrane, that in turn is supported by a frame. The reflector assembly includes a skirt that overlaps the membrane, thereby allowing large-area reflectors and low-angle ramp surfaces. A vent is formed between the skirt and the membrane, and this vent is resistant to clogging. Locating elements are placed on the frame of the pavement marker to assist in proper installation of the marker in a recess of a roadway, such that all portions of the frame are positioned below the surface of the roadway. Indentations allow the installer to gauge the level of adhesive in the recess.

17 Claims, 7 Drawing Sheets

U.S. PATENT DOCUMENTS 5,098,217 3/1992 Hedgewick et al. .
5,219,171 6/1993 Kirby et al. ..... 273/32 H
5,226,745 7/1993 Gartlacher .
5,302,048 4/1994 Paulos et al. .
5,308,186 5/1994 Hedgewick .
5,314,268 5/1994 Calandra, Jr. et al. .
5,340,103 8/1994 Kirby et al. ..... 273/32 H
5,354,143 10/1994 Lindner .
5,393,166 2/1995 Stock et al. .
5,449,244 9/1995 Sandino .
5,454,664 10/1995 Siblik .
5,502,593 3/1996 Hedgewick .
5,529,430 6/1996 Jenkins .
5,564,854 10/1996 Hedgewick .

16
42
42
62
60

RAISED PAVEMENT MARKER

BACKGROUND OF THE INVENTION

This invention relates to improvements to raised pavement markers of the type that are typically installed in a roadway, as for example to mark lane lines.

The raised pavement marker described in U.S. patent application Ser. No. 08/780,378 filed Jan. 8, 1997, assigned to the assignee of the present invention, shows exceptional promise. As explained in that application, the disclosed pavement marker is easy to install, light in weight, and able to survive snowplowing operations without damage.

The present invention is directed to various improvements that can be applied to the pavement marker of above-identified U.S. patent application Ser. No. 08/780,378. In addition, certain of these improvements can be applied generally to any suitable raised pavement marker.

SUMMARY OF THE INVENTION

The present invention is defined by the following claims, and nothing in this section should be taken as a limitation on those claims. By way of introduction, it can be said that the raised pavement marker described below provides a number of important features, including the following:

1. The pavement marker includes a reflector assembly which in turn includes a skirt that precedes radially outwardly from a reflector, also included in the reflector assembly. The skirt overlaps a radially inner portion of a membrane that supports the reflector assembly. The reflector assembly is secured in place to the membrane by snap locking the reflector assembly to an inner mounting element that is in turn integrally molded with the membrane. A vent is formed between the skirt of the reflector assembly and the membrane, and this vent preferably extends around a complete circumference of the skirt. The illustrated structure provides the advantage of a large reflector and a relatively shallow ramp angle for the reflector assembly. The large area vent is resistant to clogging.

2. One or more locating elements are mounted to the frame of the pavement marker to extend radially outwardly from the frame. These locating elements are positioned such that when the locating elements rest on the upper surface of a roadway after the frame has been installed in the roadway, the entire frame is recessed below the upper surface of the roadway. This facilitates proper installation of the pavement marker.

3. The pavement marker described below includes indentations that (1) mechanically interlock with the adhesive that holds the pavement marker in the roadway recess and (2) assist an installer in assessing adhesive level.

DETAILED DESCRIPTION OF THE PRESENTLY PREFERRED EMBODIMENT

Figure 1:
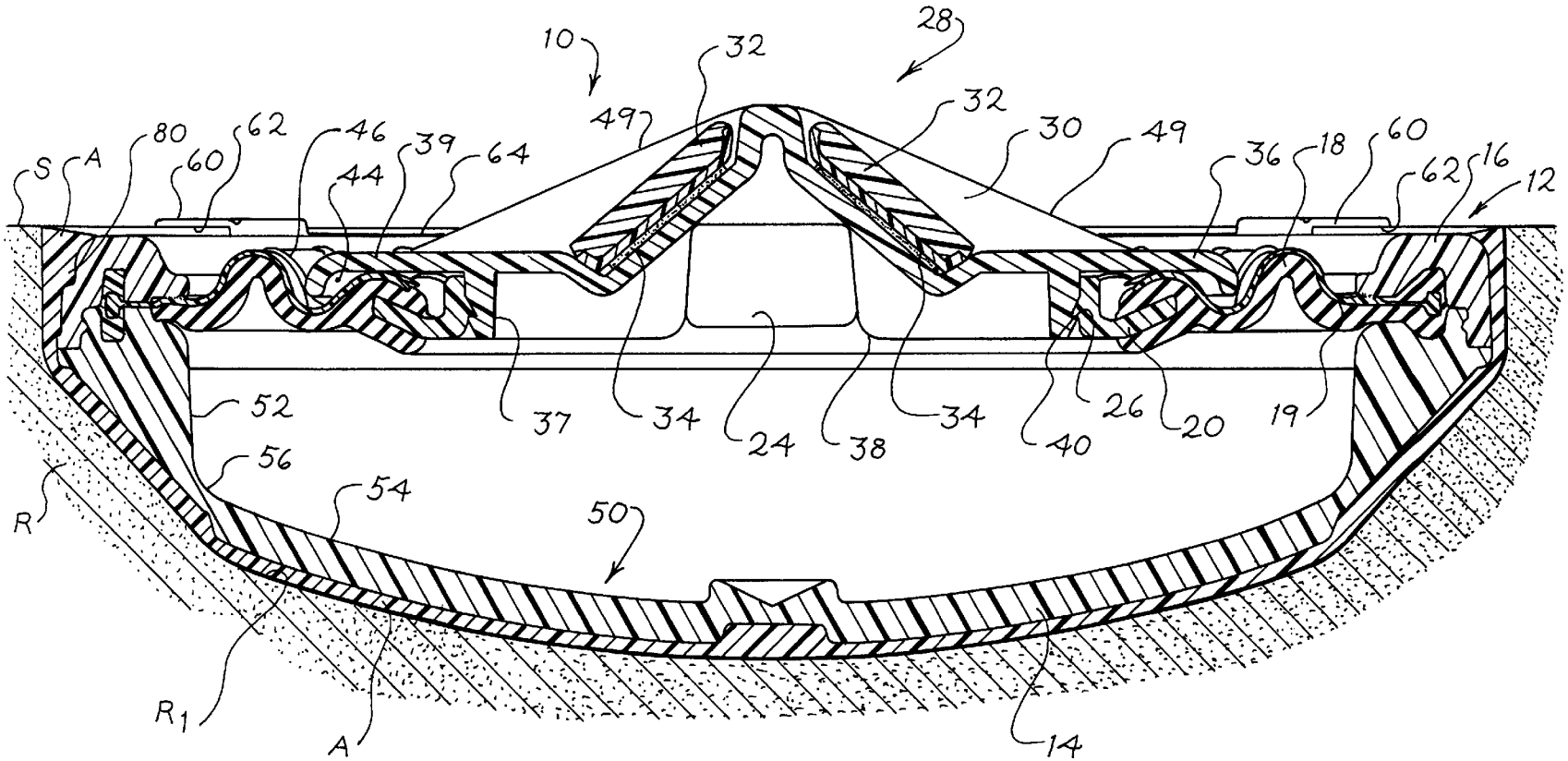
FIG. 1 is a cross-sectional view of a raised pavement marker that incorporates a preferred embodiment of this invention, mounted in place in a recess in a roadway.

Turning now to the drawings, FIG. 1 shows a cross-sectional view of a pavement marker 10 that incorporates a presently preferred embodiment of this invention. In FIG. 1 the pavement marker 10 is mounted in a recess R1 formed in the upper surface S of a roadway R. As described below, the pavement marker 10 is secured in place in the recess R1 by adhesive A.

The outer portion of the pavement marker 10 includes a frame 12 that is made up of a base 14 and a ring 16 that are snap fit together. The ring 16 is integrally molded with a resilient flexible membrane 18, and an annular mounting element 20 is integrally molded at a radially inner portion of the membrane 18.

Figure 5:
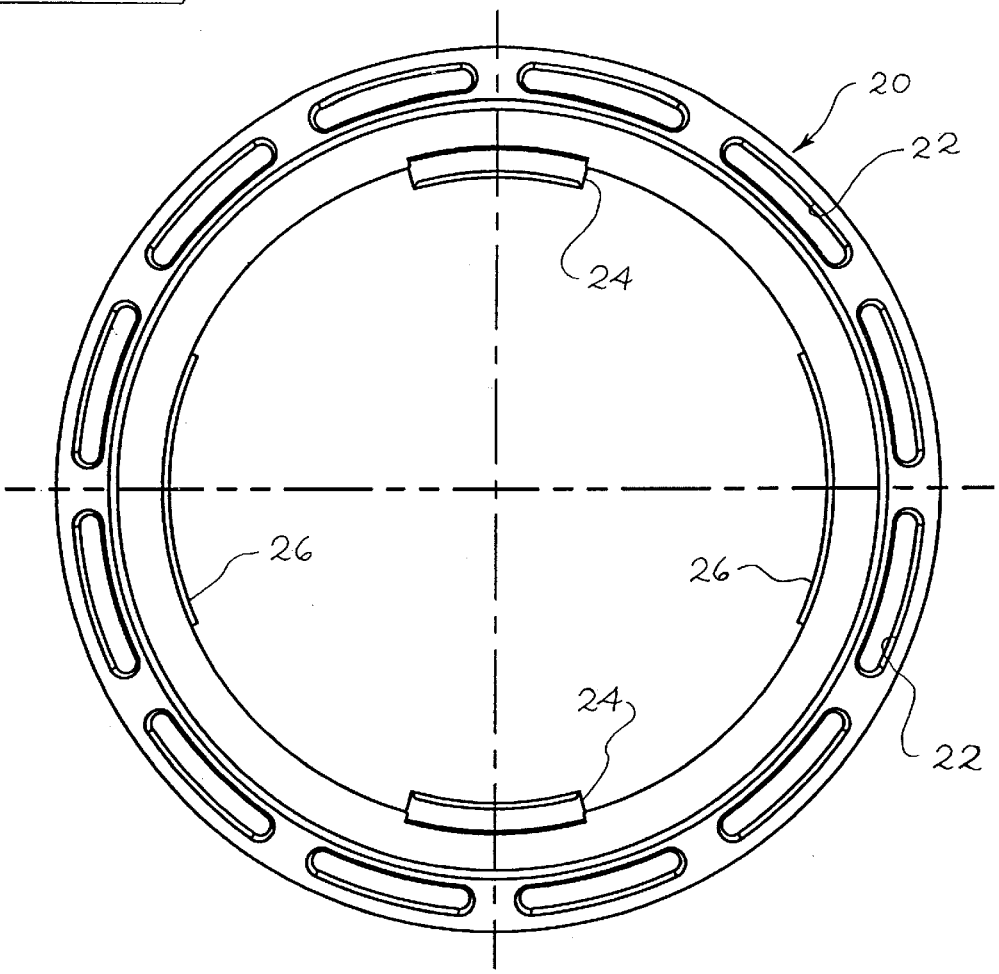
FIG. 5 is a plan view of an inner mounting element included in the pavement marker of FIG. 1.

FIG. 5 shows a top view of the mounting element 20, prior to being molded in place in the membrane 18. As shown in FIG. 5, the mounting element 20 defines an array of slots 22 that are designed to receive the molded material of the membrane 18 to securely lock the mounting element 20 and the membrane 18 together. The mounting element 20 also includes two diametrically opposed bosses 24, and two diametrically opposed barbs 26, both of which are described in detail below.

Returning to FIG. 1, the pavement marker 10 also includes a reflector assembly 28 that in this embodiment includes a substantially rigid housing 30. Two retro-reflectors 32 are secured to respective pockets defined by the housing 30 by means of a suitable adhesive 34. Recesses (not shown in FIG. 1) may be provided to facilitate removal of the retro-reflectors 32 with a bladed instrument such as a screwdriver. The housing 30 also defines an annular skirt 36 at its radially outermost portion. This skirt 36 includes a portion 39 that overlaps the membrane 18 without being attached to the resilient membrane 18.

Figure 4:
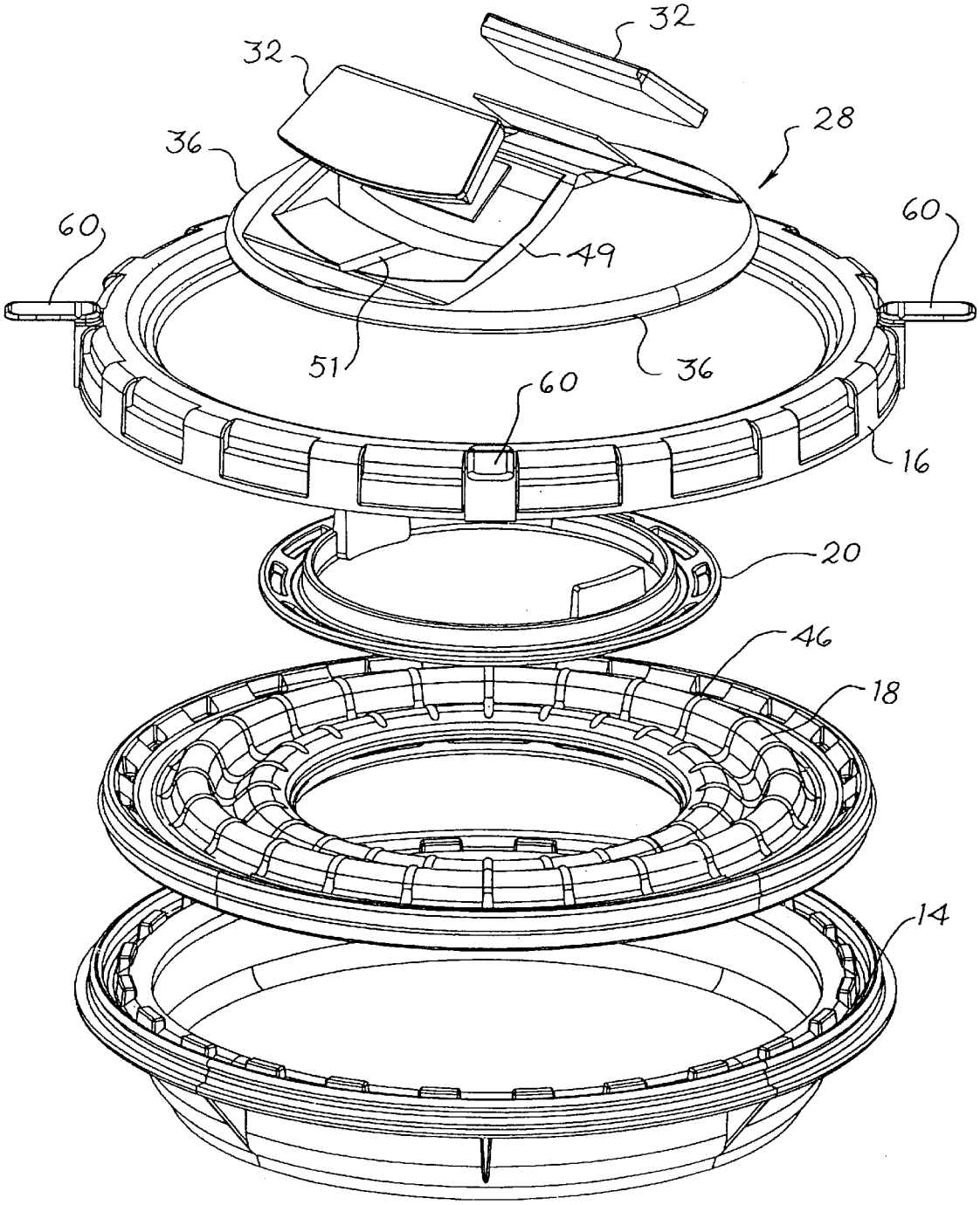
FIG. 4 is an exploded perspective view of the pavement marker of FIG. 1.

The housing 30 also defines a ring 37 as an integral part thereof. This ring 37 defines two diametrically opposed notches 38 positioned to receive respective ones of the bosses 24, as well as two diametrically opposed arcuate notches 40 configured to receive respective one of the barbs 26. The region between the skirt 36 and the membrane 18 is in fluid communication with the interior of the pavement marker 10 via passages (not shown in FIG. 1), and the entire circumferential region between the overlapping portion 39 and the membrane 18 forms a large-volume, annular vent 44 that is not easily clogged by debris. The membrane 18 includes a radial array of raised ridges 46 as shown in FIG. 4, and these ridges 46 ensure an adequate spacing between the membrane 18 and the skirt 36 to form the vent 44. In FIG. 4, the ring 16, membrane 18, and mounting element 20 are shown spaced from one another for clarity; in actual practice the ring 16 and the mounting element 20 are insert molded in the membrane 18.

Figure 2:
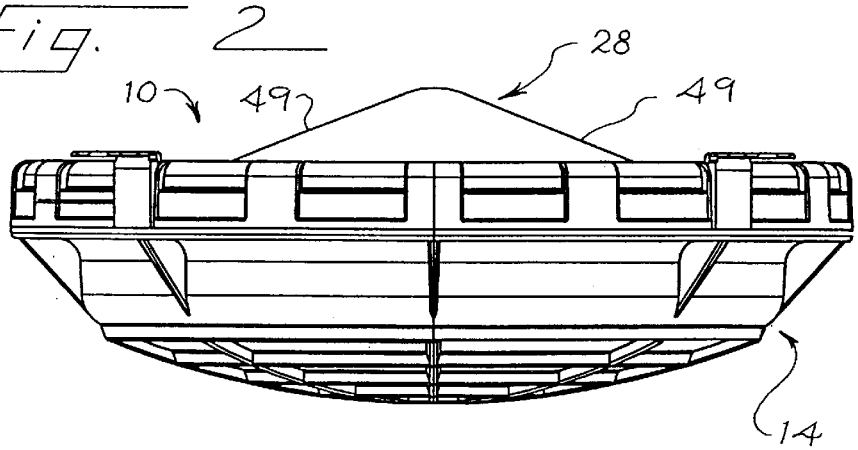
FIG. 2 is a side-view of the pavement marker of FIG. 1.
Figure 3:
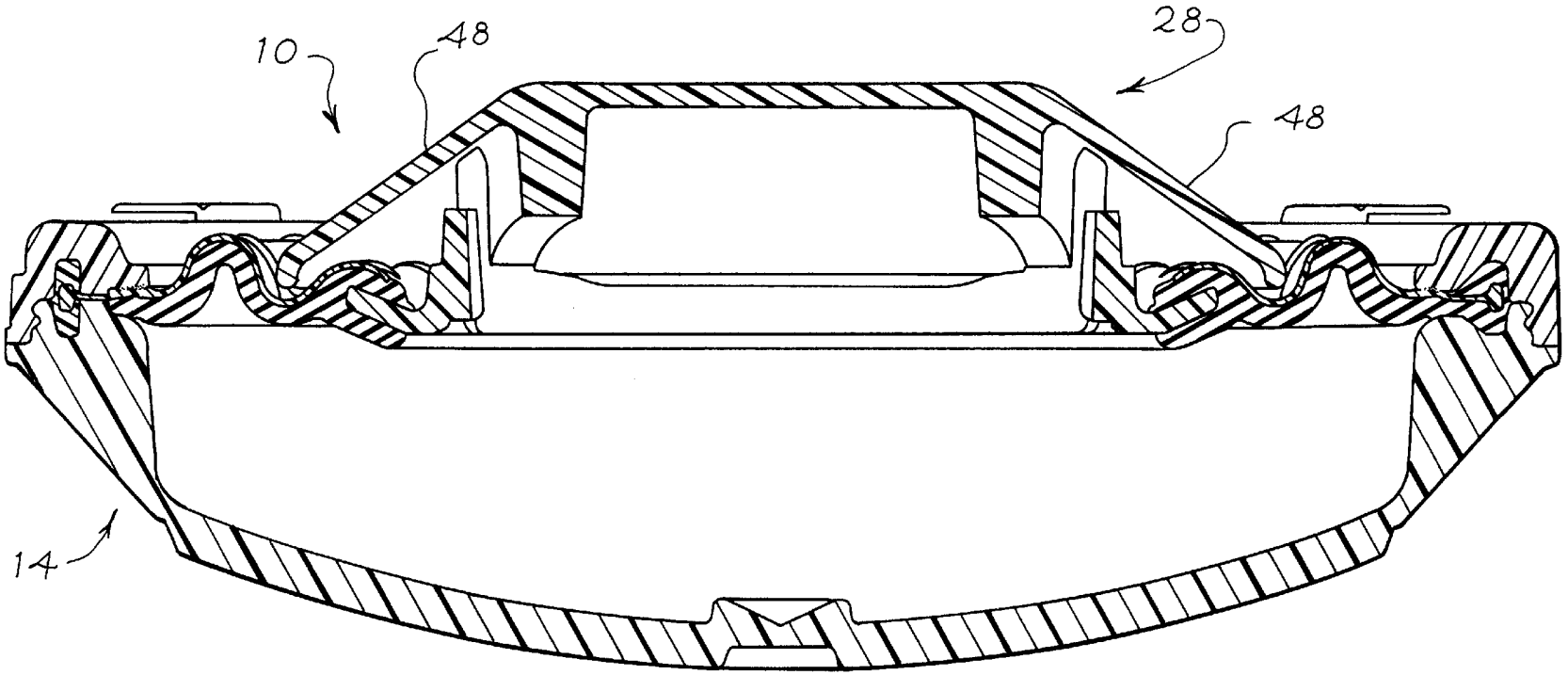
FIG. 3 is another cross-sectional view of the pavement marker of FIG. 1, taken at right angles to the side view of FIG. 2.

FIGS. 2 and 3 are side and cross-sectional views of the pavement marker 10, respectively, and they provide further details regarding the configuration of the lower surfaces of the base 14 and the upper surfaces of the reflector assembly 28. As shown in FIGS. 2 and 3, the reflector assembly 28 defines ramp surfaces 48, 49 configured to receive the impact of a tire or a snow blade, for example, and to push the reflector assembly 28 downwardly, via the resilient support of the membrane 18. The ramp surfaces 49 are preferably flat to provide a large wear surface. If desired, an optional drain slot 51 may be provided, as shown in FIG. 4.

When the reflector assembly 28 is pushed downwardly as described above, it enters a region bounded downwardly by an inner surface 50 of the base 14 (FIG. 1). This inner surface 50 is made up of an annular outer portion 52 that is joined to a domed central portion 54 at an annular corner 56. In this embodiment the outer portion 52 is substantially perpendicular to the lower surface of the reflector assembly 28. The corner 56 defines a region of greater curvature (i.e. smaller radius of curvature in this example) than either the outer portion 52 or the central portion 54. The angle between the outer portion 52 and the central portion 54 at the corner 56 is preferably an obtuse angle which is less than approximately 150°. The lowermost point of the central portion 54 is formed as a depression to center a removal bit, if necessary.

This geometry for the inner surface 50 of the base 14 allows the reflector assembly 28 to move downwardly and laterally in response to an impact on the ramp surfaces 48, all without coming into contact with or interfering with the base 14. It should be noted that the reflector assembly 28 of this embodiment has a particularly large outer diameter in comparison to the outer diameter of the frame 12. This geometry provides the advantage of reduced angles on the ramp surfaces 48 and increased size of the reflectors 32. In this embodiment the ramp angle for the reflector assembly is less than 40°, preferably less than 30°, and most preferably about 23° with respect to a horizontal line. Each of the reflectors 32 in this embodiment has an area of 1.93 $in^2$, and the ratio of the outer diameter of the reflector assembly 28 to the outer diameter of the frame 12 is 4.5 in:7 in, or 0.64. Preferably this ratio is greater than 0.55, and more preferably greater than 0.60. The geometry for the inner surface 50 described above allows such a large diameter reflector assembly 28 to be used without increasing the diameter of the frame 12. This is accomplished by providing a well that is particularly well shaped to receive the reflector assembly 28.

As best shown in FIGS. 1 and 4, the uppermost part of the frame 12 supports four locating elements 60. As best shown in FIG. 1, each of the locating elements 60 defines a lower surface 62 that is spaced somewhat above the upper peripheral surface 64 of the frame 12. Note that the locating elements 60 are formed as relatively lightweight structures that are easily broken away from the remainder of the frame 12 without damaging the frame 12. Because the lower surfaces 62 of the locating elements 60 are positioned as described above, the locating elements 60 automatically ensure that the upper peripheral surface 64 is recessed with respect to the upper surface S of the roadway R when the lower surfaces 62 are supported on the upper surface S. Though four locating elements 60 are shown in FIG. 4, it will be appreciated that a greater or smaller number can be used as desired. For example, two, three or more locating elements 60 can be used.

Figure 6:
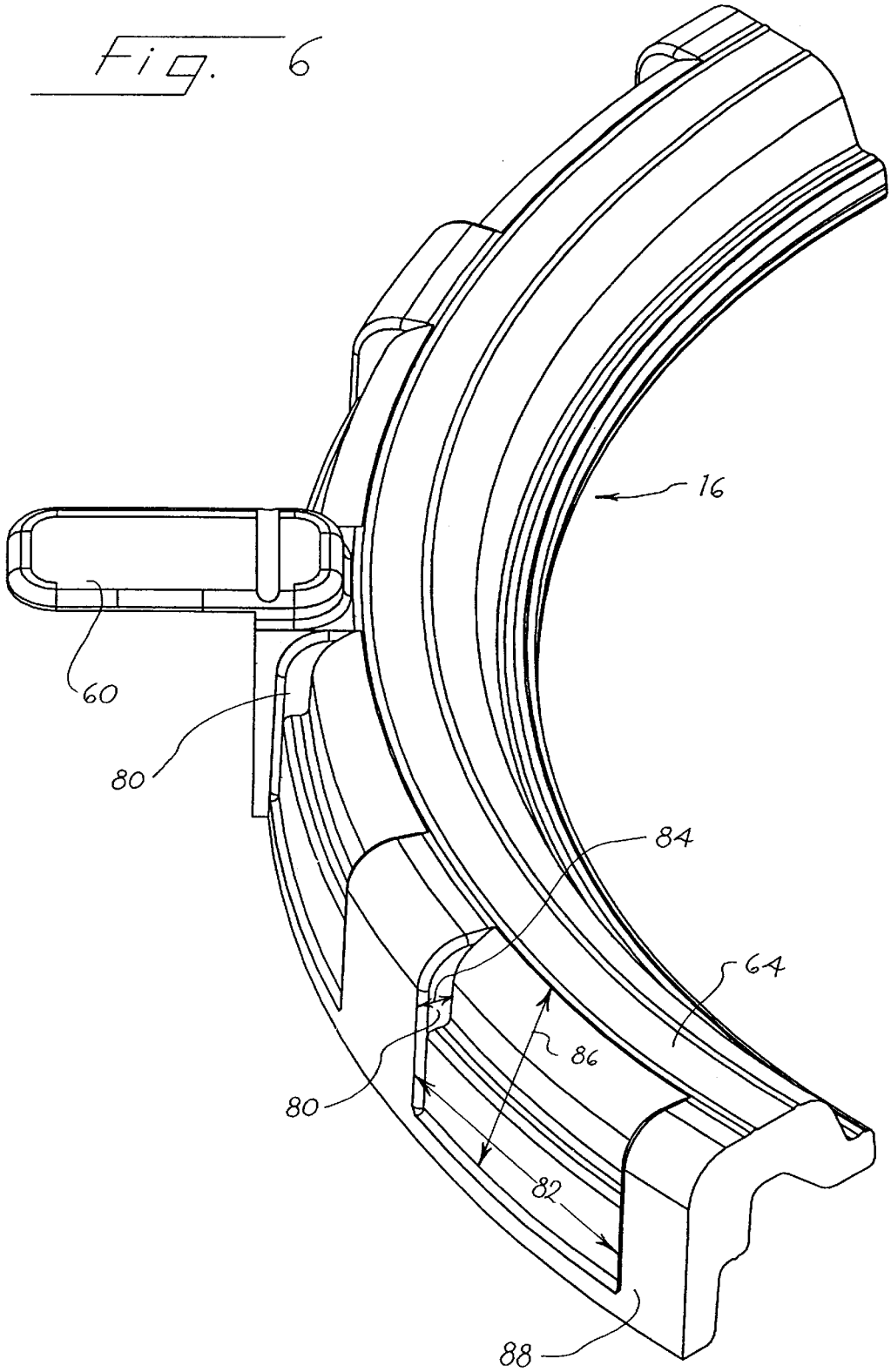
FIG. 6 is a fragmentary perspective view of a frame ring included in the pavement marker of FIG. 1.

As shown in FIGS. 1 and 6, the ring 16 defines an array of indentations 80 at its upper, outer peripheral edge. These indentations 80 are characterized by a circumferential length 82, a radial depth 84, and a height 86, as shown in FIG. 6. Each of the indentations 80 is exposed upwardly, and is positioned at a radially outermost portion 88 of the ring 16. When the pavement marker 10 is installed in the recess R1 in the roadway R, adhesive A is first placed in the recess R1, and then the pavement marker 10 is pushed against the adhesive. This movement of the pavement marker 10 causes the adhesive A to flow upwardly along the outer surface of the base 14 and the ring 16 into the indentations 80. By monitoring the level of adhesive A within the indentations 80, the installer can readily ascertain when an adequate volume of adhesive A has been placed in the recess R1. If adhesive A does not appear in all of the indentations 80 at the desired level, additional adhesive A can be added by the installer around the circumference of the pavement marker 10. It is anticipated that the indentations 80 will allow proper installation of the pavement marker 10 while minimizing the amount of adhesive A that is used. In this way the cost of installation will be reduced. Additionally, the indentations 80 enhance the mechanical interlock between the hardened adhesive A and the marker 10 to hold the marker against upward movement out of the recess R1.

Figure 7:
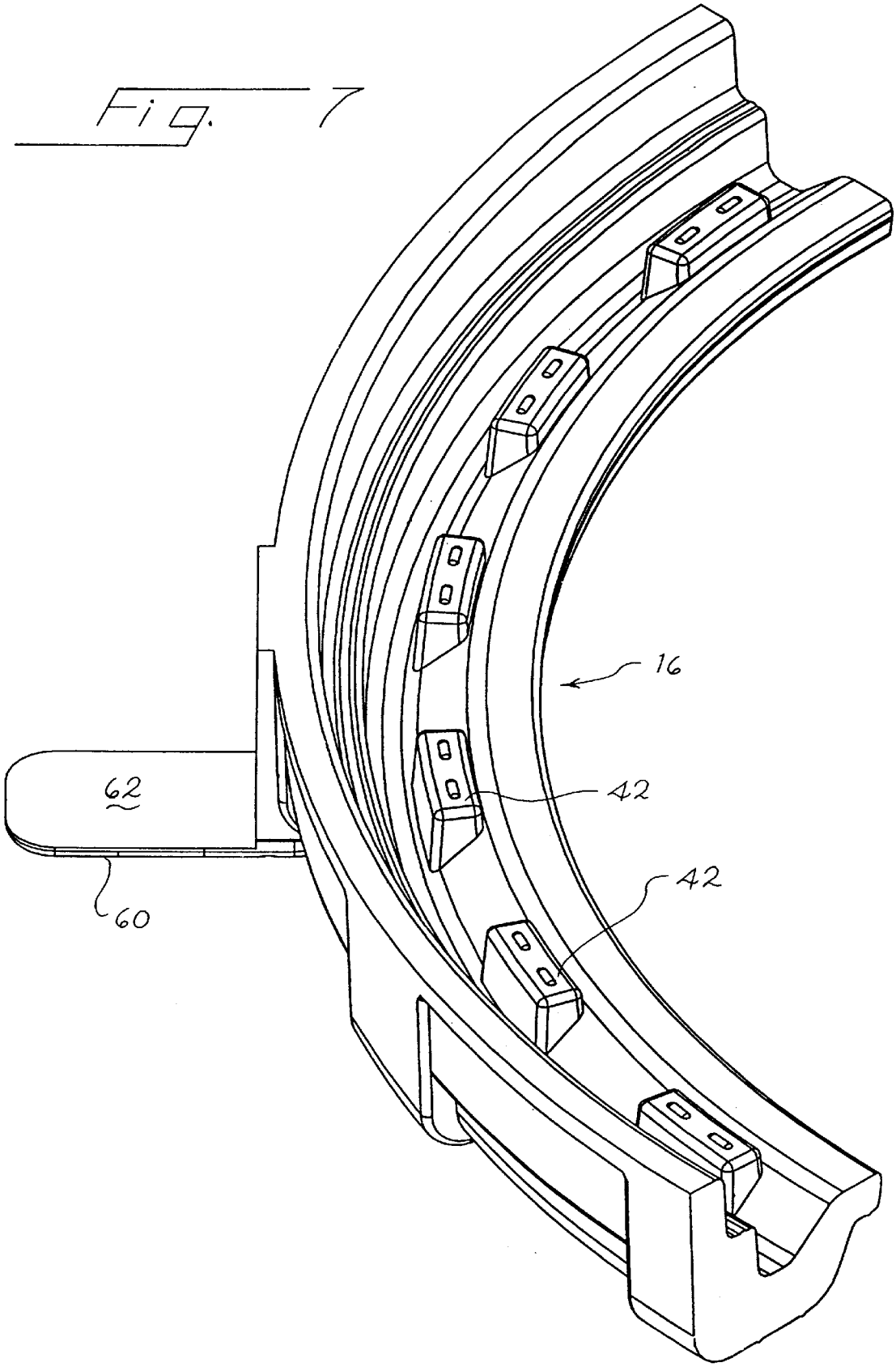
FIG. 7 is a fragmentary perspective view of an underside of the frame ring of FIG. 6.
Figure 8:
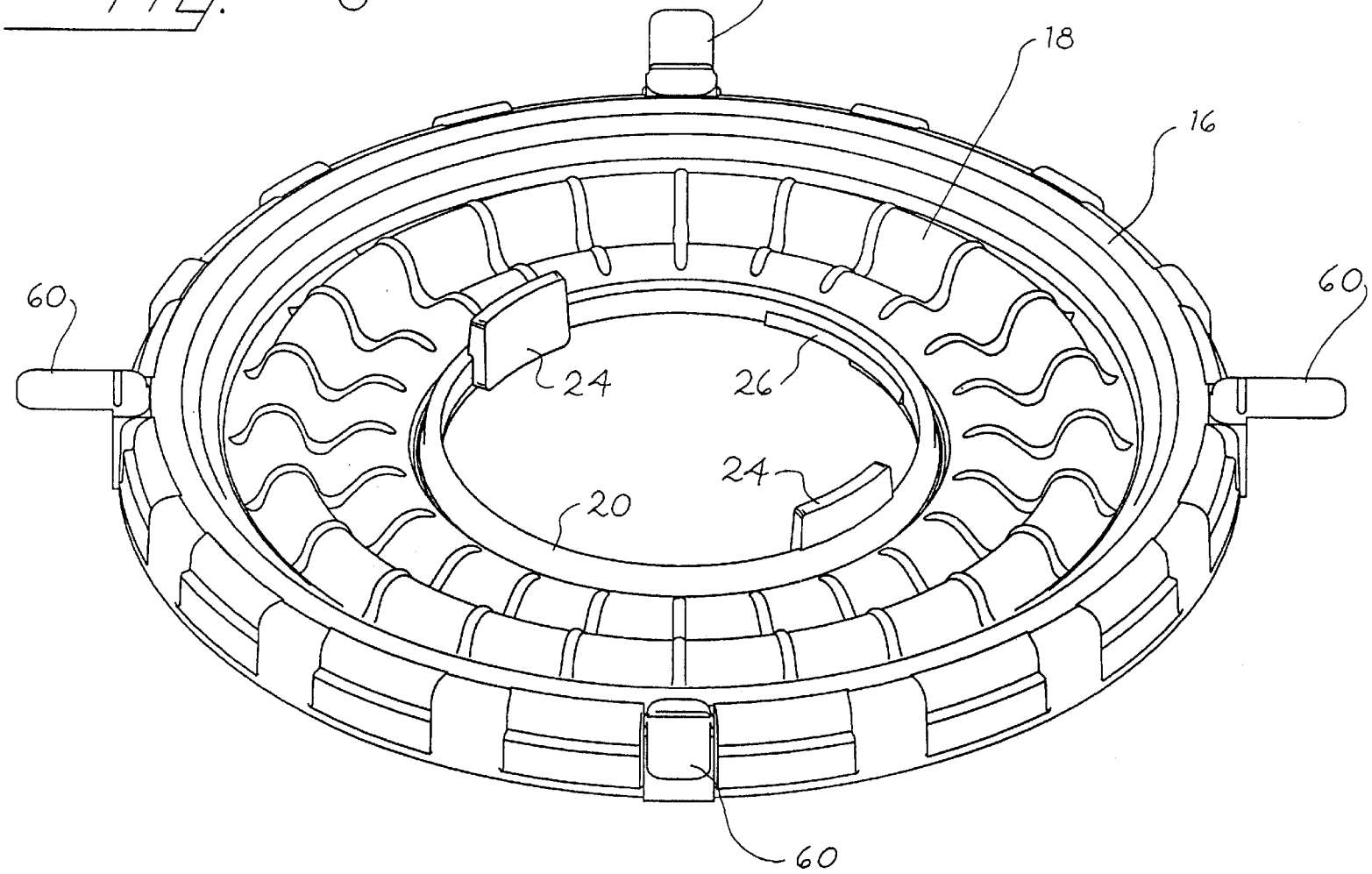
FIG. 8 is a perspective view of a membrane assembly included in the pavement marker of FIG. 1, including a mounting element, molded to the frame ring.

The pavement marker 10 is fabricated by first separately molding the base 14, the ring 16, the mounting element 20, and the reflector assembly 28. Then the ring 16 and the mounting element 20 are placed within an injection mold, and the membrane 18 is co-molded with and partially around the ring 16 and the mounting element 20 to produce the sub-assembly of FIG. 8. FIG. 7 shows the underside of the ring 16, prior to the point where the ring 16 is co-molded with the membrane 18. As shown in FIG. 7, the ring 16 includes an array of bosses 42 designed to fit into the membrane 18 and to secure the membrane 18 to the ring 16.

Once this sub-assembly has been formed, it can be assembled with the base 14 using a conventional snap-fit as described in above-identified U.S. patent application Ser. No. 08/780,378 filed Jan. 8, 1997, the specification of which is hereby incorporated by reference. Similarly, the reflector housing 28 can be snapped in place in the mounting element 20 such that the annular notches 40 engage the annular barbs 26. The reflectors 32 can be adhesively mounted on the reflector assembly 28 at any desired point in the assembly process.

Simply by way of example, the following materials have been found suitable for use with the pavement marker 10. These materials are of course only intended by way of illustration, and many alternatives are possible. For example, a nylon mesh may be molded into the upper surface of the membrane 18 to strengthen it against tearing, as shown in FIG. 1 at 19. This nylon mesh may have a phosphorescent material molded into it.

| Element | Preferred Material |
|---|---|
| Base 14 | Nylon 6/6 (33% glass filled) |
| Ring 16 | Nylon 6/6 (33% glass filled) |
| Membrane 18 | Silicone (Modified, 40 Durometer) |
| Mounting Element 20 | Nylon 6/6 (13–15% glass filled, impact-modified) |
| Housing 30 | Polyurethane (60% long glass fiber filled, Dow Isoplast 101LGF60) |
| Reflector 32 | Polycarbonate (UV stabilized, hardcoated) |
| Adhesive 34 | Butyl rubber tape (double sided, 0.031 in thick) |
| Adhesive A | hot applied rubberized bitumen (Crafco) or two-component epoxy (100% solids, PolyCarb Mark 29 or similar) |

Once the pavement marker 10 is assembled as described above, it can be readily installed in the roadway using a suitable adhesive A. The installation techniques described in the above-identified U.S. patent application Ser. No. 08/780,378 can be used.

During installation, the pavement marker 10 is pressed into the recess R1 until the lower surfaces 62 of the locating elements 60 come to rest on the upper surface S of the roadway R. When the pavement marker 10 is placed in this position, all portions of the frame 12 are disposed below the upper surface S. This reduces or even eliminates the chance of an improper installation, in which the uppermost peripheral surface 64 of the frame 12 extends above the upper surface S of the roadway R. In such an improper installation the frame 12 can be damaged or the pavement marker 10 can be dislodged by contact of an object such as a snowplow blade with the pavement marker 10. Of course, a snowplow blade may come into contact with the locating elements 60. However, because the locating elements 60 are designed to break away easily from the ring 16 without damaging the ring 16, damage to the locating elements 60 after installation does not create an operational problem. The level of the adhesive A can be observed in the indentations 80 to confirm proper installation.

Of course, it should be understood that the foregoing detailed description has been intended by way of illustration and not by way of limitation. Many changes and alternatives can be made to the preferred embodiment described above. For example, though it is preferred to use the various improvements described above in combination, they can also be used separately from one another. Also, the ring 16 may be designed to be removable from the base 14. Furthermore, many of the improvements of this invention can be used with other types of pavement markers which do not include a membrane that supports a reflector housing on a frame.

Since the foregoing detailed description has described only a few of the many alternative forms this invention can take, it is intended that only the following claims, including all equivalents, be regarded as a definition of this invention.

We claim:

1. In a raised pavement marker comprising a frame, a flexible membrane supported by the frame, and a reflector assembly supported by the membrane for vertical movement with respect to the frame, the improvement comprising:

said reflector assembly comprising a reflector and a skirt proceeding radially outwardly from the reflector, said skirt comprising an overlapping portion that overlaps a radially inward portion of the membrane, said overlapping portion of the skirt exposed at an upper side of the reflector assembly; and a vent formed between the radially inward portion of the membrane and the overlapping portion of the skirt.

2. The pavement marker of claim 1 wherein the skirt comprises an unsecured portion overlapping the membrane.

3. The pavement marker of claim 1 wherein the reflector assembly further comprises a ramp surface extending upwardly from the skirt.

4. The pavement marker of claim 1 wherein said membrane comprises an annular trough, and wherein said overlapping portion of the skirt comprises a downwardly extending lip situated over the annular trough.

5. The pavement marker of claim 1 wherein the membrane comprises an array of ridges that engage the overlapping portion of the skirt to hold the vent open.

6. In a raised pavement marker comprising a frame, a flexible membrane supported by the frame, and a reflector assembly supported by the membrane for vertical movement with respect to the frame, the improvement comprising:

said reflector assembly comprising a reflector and a skirt proceeding radially outwardly from the reflector, said skirt comprising an overlapping portion that overlaps a radially inward portion of the membrane, said overlapping portion of the skirt exposed at an upper side of the reflector assembly;

wherein the membrane comprises an integrally molded mounting element, wherein the reflector assembly is secured to the mounting element, and wherein the mounting element is formed separately from the reflector assembly.

7. The pavement marker of claim 6 wherein the mounting element and the reflector assembly comprise mating snap lock elements that cooperate to secure the reflector assembly to the mounting element.

8. The pavement marker of claim 6 further comprising a vent formed between the membrane and the reflector assembly adjacent the skirt, said vent communicating with a space bounded by the frame, the membrane, and the reflector assembly.

9. The pavement marker of claim 8 wherein the vent extends around a complete circumference of the skirt.

10. A raised pavement marker comprising a frame and a reflector assembly supported by the frame, said frame comprising an upper perimeter surface that is substantially circular in horizontal section, the improvement comprising:

a set of indentations formed in the upper perimeter surface at a radially outermost portion of the upper perimeter surface, said indentations alternating with intervening raised portions of the perimeter surface around the substantially circular upper perimeter portion and configured to receive an adhesive flowing upwardly along the frame when the pavement marker is adhesively secured in place in a recess in a roadway.

11. The pavement marker of claim 10 wherein the indentations are generally rectangular in shape.

12. The pavement marker of claim 10 wherein the indentations are open at an upper portion of the frame, thereby assisting an installer in assessing adhesive level adjacent the frame of the installed pavement marker.

13. In a raised pavement marker comprising a frame, a flexible membrane supported by the frame, and a reflector assembly supported by the membrane for vertical movement with respect to the frame, the improvement comprising:

an inner surface formed by the frame under the membrane and the reflector assembly, said inner surface comprising an annular outer portion and a central portion, said central portion joined to the outer portion at a corner characterized by a substantially greater curvature than central portion, said inner surface configured to avoid contact with the reflector assembly when the reflector assembly moves toward the central portion;

said frame comprising an outer diameter $D_1$, said reflector housing comprising an outer diameter $D_2$, wherein $D_2/D_1$ is greater than 0.55.

14. The pavement marker of claim 13 wherein the outer portion is oriented substantially perpendicularly to a lower surface of the reflector assembly.

15. The pavement marker of claim 13 wherein the central portion is oriented at an obtuse angle less than 150° with respect to the outer portion in radial cross section.

16. The pavement marker of claim 13 wherein $D_2/D_1$ is greater than 0.60.

17. The pavement marker of claim 13 wherein $D_2/D_1$ is greater than 0.65.

* * * * *